US006761397B1

(12) United States Patent
Tseng

(10) Patent No.: US 6,761,397 B1
(45) Date of Patent: Jul. 13, 2004

(54) FOLDABLE CHAIR WITH AN ARMREST-SUPPORTING UNIT

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/618,355

(22) Filed: Jul. 11, 2003

(51) Int. Cl.[7] ..... A47D 1/02

(52) U.S. Cl. ..... 297/40; 297/115; 297/354.13; 297/411.32

(58) Field of Search ..... 297/354.12, 378.1, 297/22, 27, 35, 40, 115, 354.13, 411.3, 411.32, 411.33, 411.34, 411.4, 411.38, 411.36

(56) References Cited

U.S. PATENT DOCUMENTS 1,399,744 A * 12/1921 Brophy ..... 297/411.33
2,658,560 A * 11/1953 Cawthon ..... 297/411.24
3,865,434 A * 2/1975 Sully ..... 297/411.33
4,252,371 A * 2/1981 Lehnen ..... 297/411.4
4,684,170 A * 8/1987 Colby ..... 297/19
6,397,416 B2 * 6/2002 Brooke et al. ..... 5/662

FOREIGN PATENT DOCUMENTS

JP 58-224818 * 12/1983

* cited by examiner

*Primary Examiner*—Laurie K. Cranmer
(74) *Attorney, Agent, or Firm*—Ladas & Parry

(57) ABSTRACT

A foldable chair includes a base frame with left and right seat rods, left and right armrests respectively aligned with the left and right seat rods, and front and rear armrest-supporting members that are pivoted to the left and right seat rods. Each of the front and rear armrest-supporting members includes left and right poles and a stopper. Each of the left and right poles is pivoted to a respective one of the left and right seat rods and a respective one of the left and right armrests. The stopper interconnects lower ends of the left and right poles, and abuts against bottom ends of the left and right seat rods when the front and rear armrest-supporting members are disposed at an extended position.

4 Claims, 7 Drawing Sheets

FOLDABLE CHAIR WITH AN ARMREST-SUPPORTING UNIT

BACKGROUND OF THE INVENTION

1. Field of the Invention

This invention relates to a foldable chair, more particularly to a foldable chair with a pair of armrests that are pivoted to a base frame through an armrest-supporting unit.

2. Description of the Related Art

FIG. 1 illustrates a conventional foldable chair 1 that includes a seat 12, a backrest 13 pivoted to the seat 12, a rear leg unit 14, a front leg unit 15, and a pair of armrests 11, each of which is pivoted to the backrest 13 and the rear leg unit 14. The conventional foldable chair 1 is disadvantageous in that since the armrests 11 are pivoted to the backrest 13, movements of the backrest 13 and the armrests 11 are dependent of each other, which can result in inconvenience when the chair 1 is in use.

SUMMARY OF THE INVENTION

Therefore, the object of the present invention is to provide a foldable chair that is capable of overcoming the aforesaid drawback of the prior art.

According to the present invention, there is provided a foldable chair that comprises: a seat unit having a base frame which includes left and right seat rods that extend in a longitudinal direction and that have bottom ends, respectively; a backrest frame pivoted to the seat unit; left and right armrests respectively disposed above and aligned with the left and right seat rods of the base frame; and front and rear armrest-supporting members that are spaced apart from each other in the longitudinal direction and that are pivoted to the left and right seat rods of the base frame so as to be rotatable relative to the base frame about an axis. Each of the front and rear armrest-supporting members includes left and right poles that sandwich the left and right seat rods of the base frame therebetween, and a stopper. Each of the left and right poles is pivoted to a respective one of the left and right seat rods and a respective one of the left and right armrests, and has a lower end that is disposed below the base frame. The stopper is disposed below the base frame, extends laterally and transversely relative to the left and right seat rods of the base frame, and interconnects the lower ends of the left and right poles. Each of the front and rear armrest-supporting members is rotatable relative to the base frame about the axis between an extended position, in which each of the left and right poles extends downwardly and frontwardly from the respective one of the left and right armrests to the stopper, in which the stopper is disposed frontwardly of the axis, and in which the stopper abuts against the bottom ends of the left and right seat rods, and a folded position, in which each of the left and right poles extends downwardly and rearwardly from the respective one of the left and right armrests to the stopper, in which the stopper is disposed rearwardly of the axis, and in which the stopper abuts against the bottom ends of the left and right seat rods.

BRIEF DESCRIPTION OF THE DRAWINGS

In drawings which illustrate an embodiment of the invention.

DETAILED DESCRIPTION OF THE PREFERRED EMBODIMENT

Figure 1:
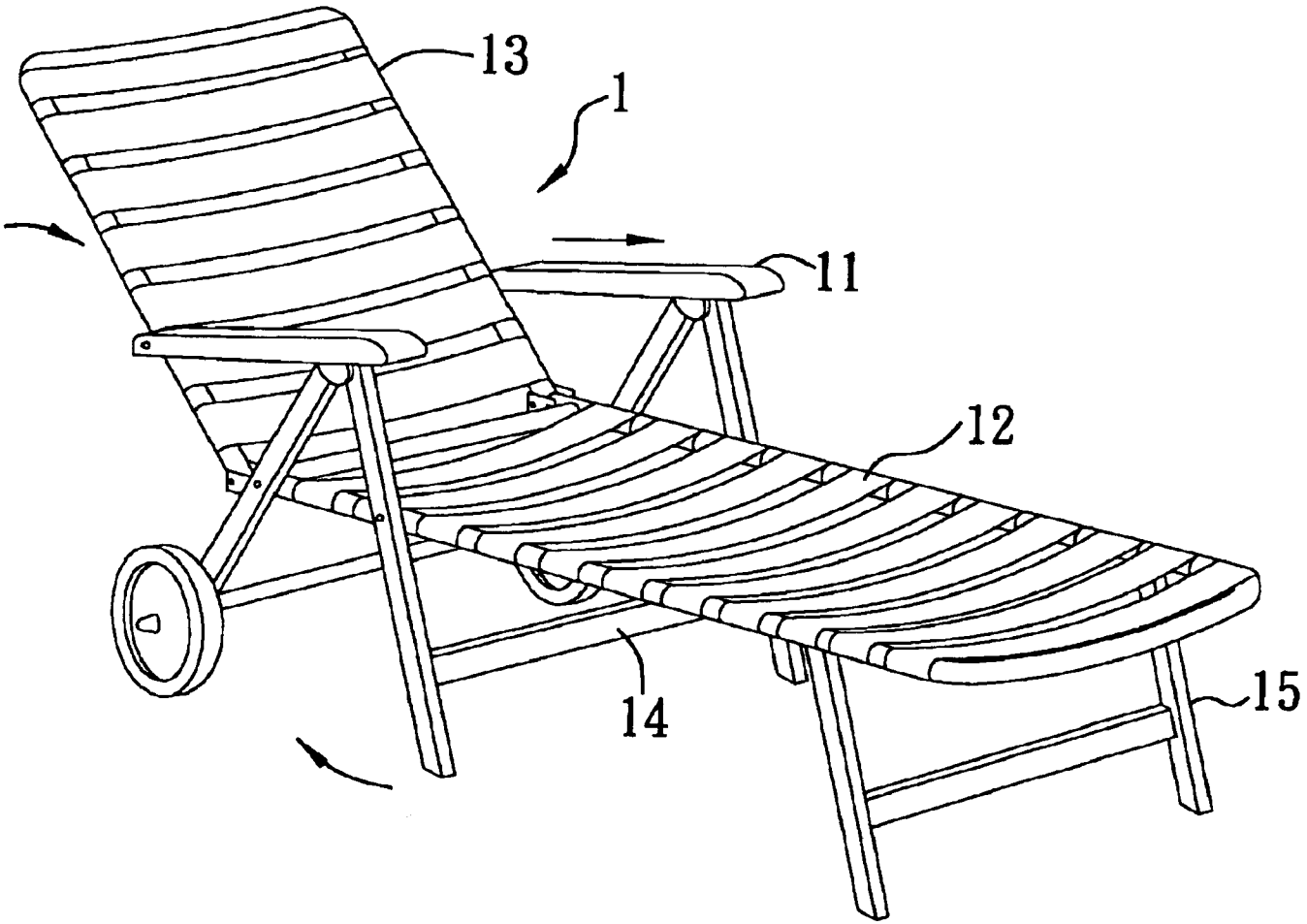
FIG. 1 PRIOR ART
FIG. 1 is a perspective view of a conventional foldable chair.
Figure 2:
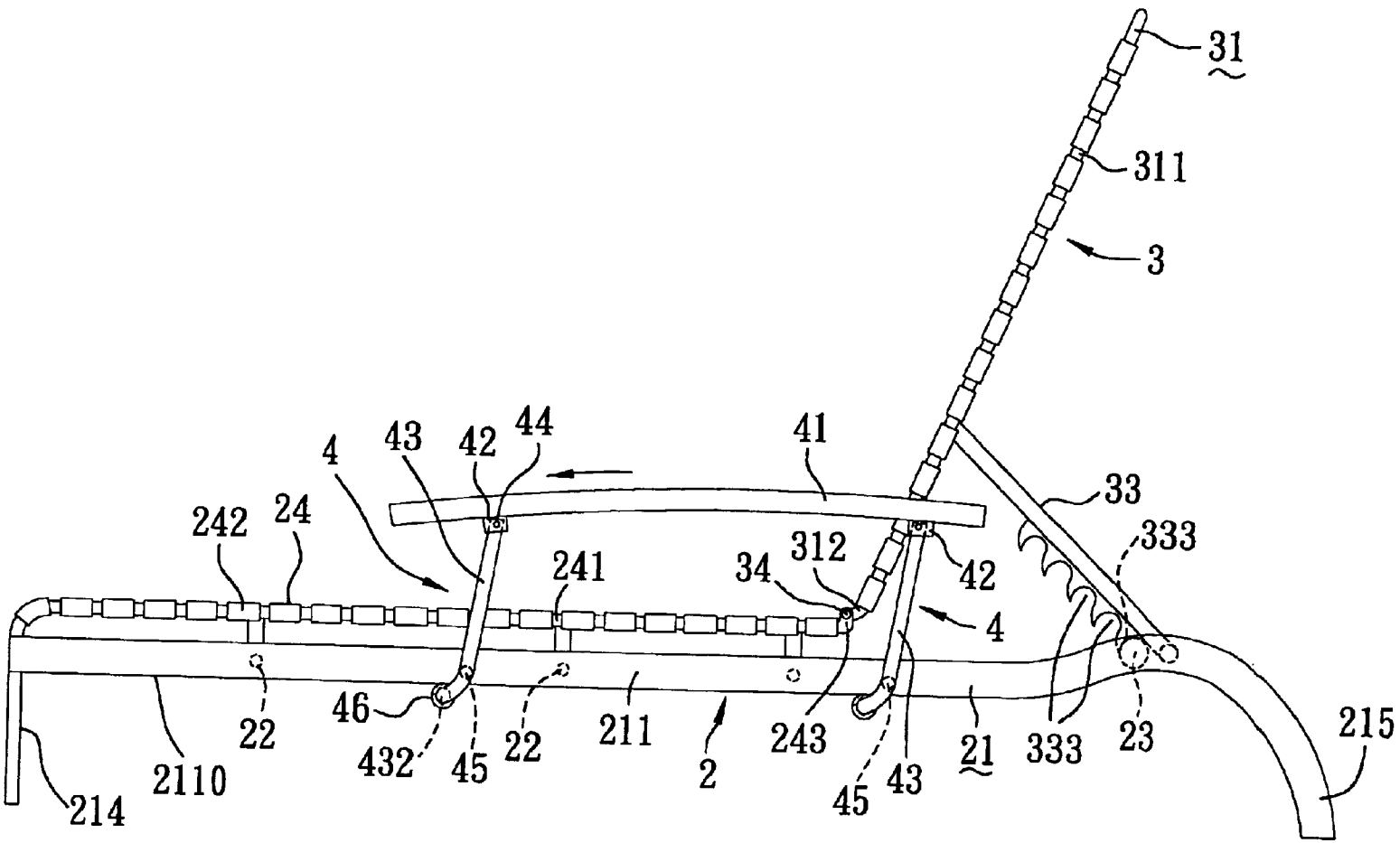
FIG. 2 is a schematic side view of a foldable chair embodying this invention.
Figure 3:
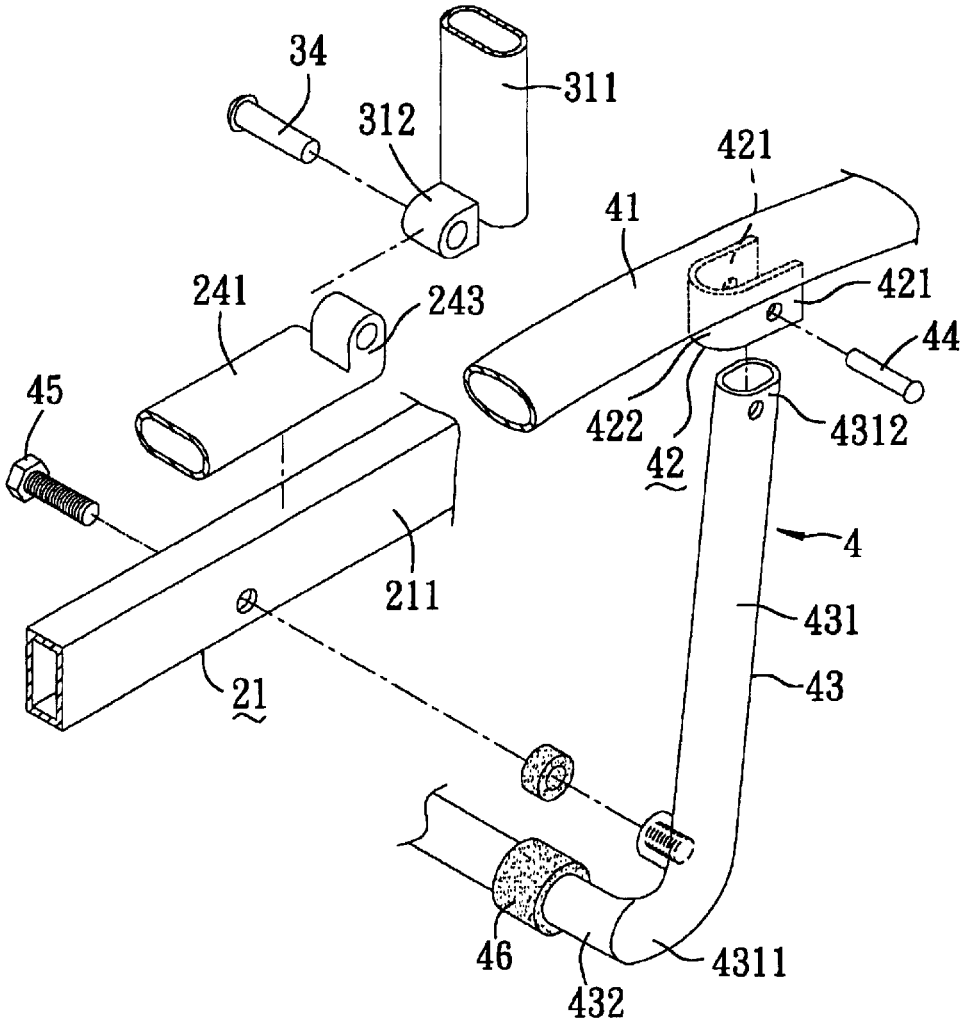
FIG. 3 is a fragmentary, exploded perspective view of the foldable chair of FIG. 2.
Figure 4:
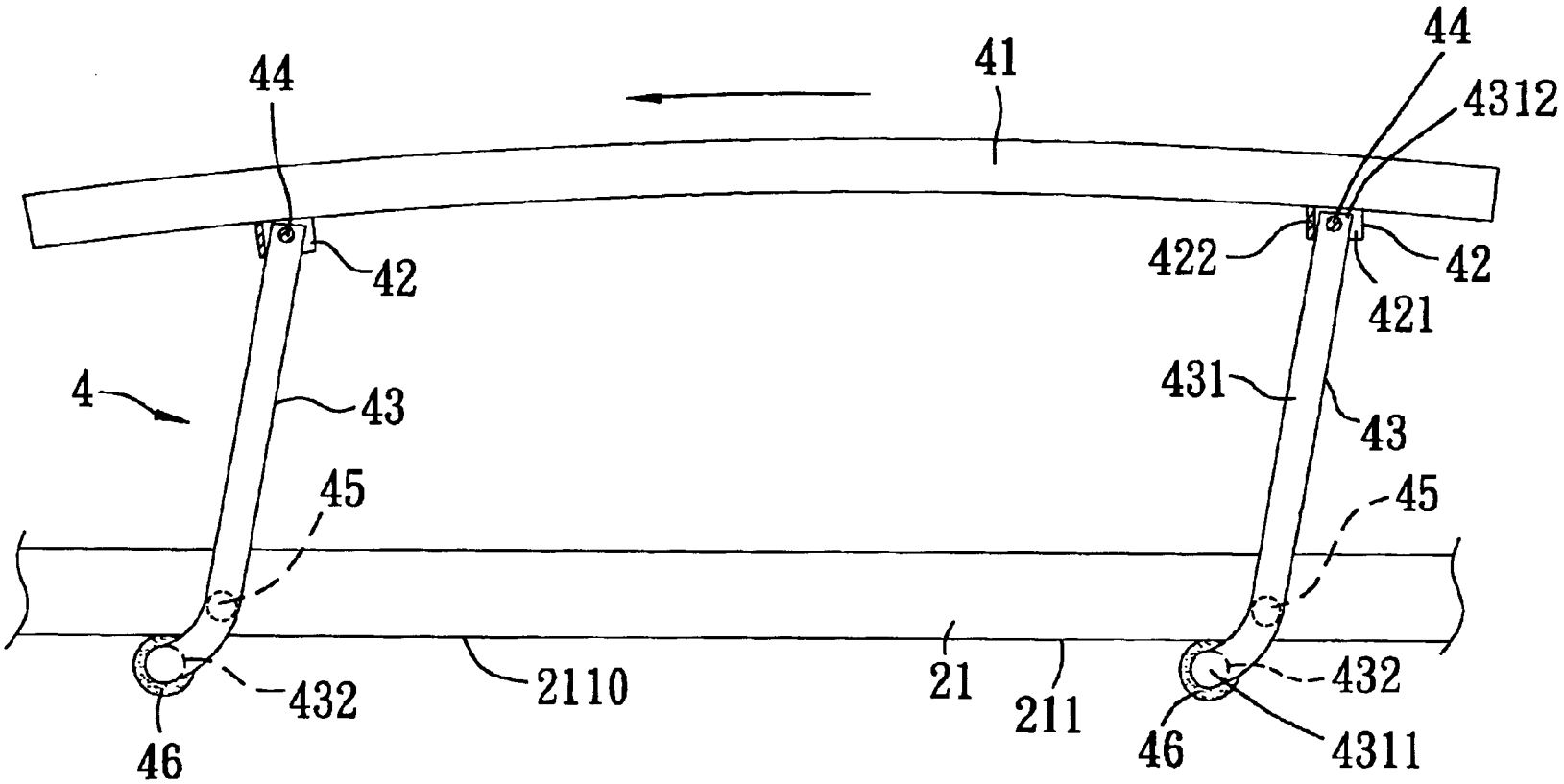
FIG. 4 is a fragmentary, schematic side view to illustrate how an armrest-supporting unit moves relative to a base frame of the foldable chair of FIG. 2.
Figure 5:
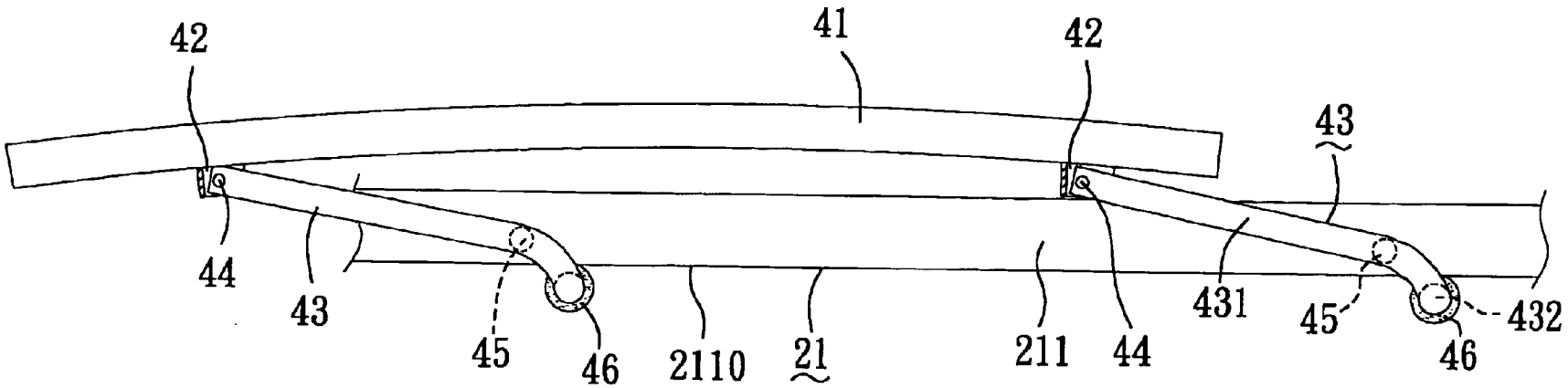
FIG. 5 is a fragmentary, schematic side view to illustrate how the armrest-supporting unit moves to a folded position relative to the base frame of the foldable chair of FIG. 2.
Figure 6:
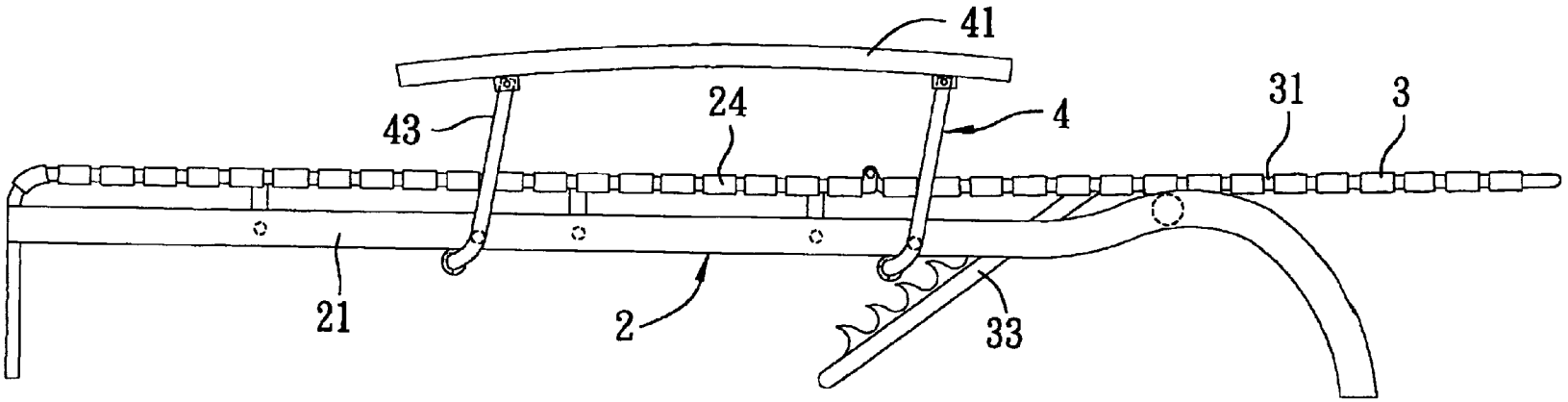
FIG. 6 is a schematic side view to illustrate how a backrest unit is disposed at a fully extended state.
Figure 7:
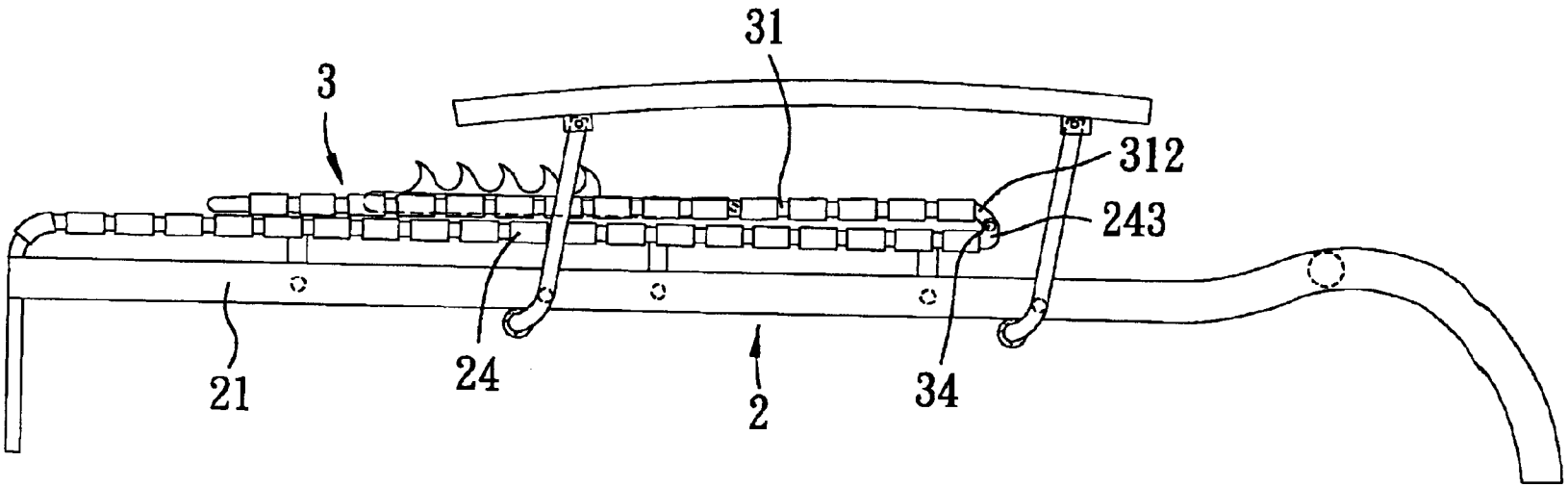
FIG. 7 is a schematic side view to illustrate how the backrest unit is disposed at a folded state.

FIGS. 2 to 7 illustrate a foldable chair embodying this invention. The foldable chair includes a seat unit 2, a backrest unit 3, a pair of left and right armrests 41, and an armrest-supporting unit 4.

The seat unit 2 includes a base frame 21 having left and right seat rods 211 that extend in a longitudinal direction and that have bottom ends 2110, respectively, a plurality of parallel interconnecting rods 22, each of which interconnects the left and right seat rods 211, a rear seat rod 23 that interconnects and that extends in a transverse direction relative to the left and right seat rods 211, and a seating member 24 mounted on and spanning the left and right seat rods 211. The seating member 24 includes left and right supporting rods 241, and a plurality of parallel strips 242 of plastic sheet 242, each of which interconnects the left and right supporting rods 241. Each of the left and right supporting rods 241 has a pivot end that is formed with a first stud 243. Front and rear legs 214, 215 extend downwardly from the left and right seat rods 211.

The backrest unit 3 includes a backrest frame 31 that is pivoted to the base frame 21. The backrest frame 31 includes left and right backrest rods 311 that are respectively pivoted to the left and right supporting rods 241 through a pair of pivots 34 so as to permit pivoting movement of the backrest frame 31 relative to the seat unit 2 between a fully extended state (see FIG. 6), in which the backrest frame 31 is disposed at a level the same as that of the seating member 24, and a folded state (see FIG. 7), in which the backrest frame 31 is stacked above the seating member 24. Each of the left and right backrest rods 311 has a pivot end that is formed with a second stud 312 which is aligned with the first stud 243 of the respective one of the left and right supporting rods 241. Each pivot 34 extends through the first stud 243 of the respective one of the left and right supporting rods and the second stud 312 of the respective one of the left and right backrest rods 311. Each adjacent pair of the first and second studs 243, 312 are juxtaposed to each other in such a manner to permit the backrest frame 31 to be substantially parallel to the seating member 24 when the backrest frame 31 is disposed at the folded state.

The left and right armrests 41 are respectively disposed above and aligned with the left and right seat rods 211 of the base frame 21.

The armrest-supporting unit 4 includes front and rear armrest-supporting members 43 that are spaced apart from each other in the longitudinal direction and that are pivoted to the left and right seat rods 211 of the base frame 21 through pivot pins 45 so as to be rotatable relative to the base frame 21 about an axis defined by the respective pivot pin 45. Each of the front and rear armrest-supporting members 43 includes left and right poles 431 that sandwich the left and right seat rods 211 of the base frame 21 therebetween, and a stopper 432. Each of the left and right poles 431 is pivoted to a respective one of the left and right seat rods 211 and a respective one of the left and right armrests 41, and has a lower end 4311 that is disposed below the base frame 21. The stopper 432 is disposed below the base frame. 21, extends laterally and transversely relative to the left and right seat rods 211 of the base frame 21, and interconnects the lower ends 4311 of the left and right poles 431. Each of the front and rear armrest-supporting members 43 is rotatable relative to the base frame 21 about the axis between an extended position (see FIG. 4), in which each of the left and right poles 431 extends downwardly and frontwardly from the respective one of the left and right armrests 41 to the stopper 432, in which the stopper 432 is disposed frontwardly of the axis, and in which the stopper 432 abuts against the bottom ends 2110 of the left and right seat rods 211 so as to prevent undesired rearward movement of the left and right armrest-supporting members 43 relative to the seat frame 21, and a folded position (see FIG. 5), in which each of the left and right poles 431 extends downwardly and rearwardly from the respective one of the left and right armrests 41 to the stopper 432, in which the stopper 432 is disposed rearwardly of the axis, and in which the stopper 432 abuts against the bottom ends 2110 of the left and right seat rods 211. Preferably, a protective sleeve 46 is sleeved on the stopper 432 to contact the bottom ends 2110 of the left and right seat rods 211.

Each of the left and right armrests 41 has a bottom end that is formed with a pair of brackets 42. Each of the brackets 42 has a bight portion 422 and two opposite arm portions 421 extending from two opposite ends of the bight portion 422 in the longitudinal direction and cooperatively defining a receiving space therebetween. Each of the left and right poles 431 further has an upper end 4312 that is opposite to the lower end 4311, that is received in the receiving space in the respective one of the brackets 42, and that is pivoted to the arm portions 421 of the respective one of the brackets 42 through a pivot pin 44. Each of the left and right poles 431 abuts against the bight portion 422 of the respective one of the brackets 42 when the left and right armrest-supporting members 43 are disposed at the extended position so as to prevent undesired movement of the armrests 41 relative to the left and right armrest-supporting members 43.

A position-adjusting member 33 extends rearwardly and downwardly from the backrest frame 31 toward the rear seat rod 23, and is formed with a series of engaging grooves 333 which open downwardly. The rear seat rod 23 releasably engages a selected one of the engaging grooves 333 so as to position the backrest frame 31 at a desired inclination relative to the base frame 21.

Since the armrests 41 are independent of the backrest unit 3, the aforesaid drawback as encountered in the prior art can be eliminated. Moreover, by virtue of the armrest-supporting unit 4, the armrests 41 can be easily and conveniently moved between extended and folded positions.

With the invention thus explained, it is apparent that various modifications and variations can be made without departing from the spirit of the present invention.

I claim:

1. A foldable chair comprising:

a seat unit having a base frame which includes left and right seat rods that extend in a longitudinal direction and that have bottom ends, respectively;

a backrest frame pivoted to said seat unit;

left and right armrests respectively disposed above and aligned with said left and right seat rods of said base frame; and front and rear armrest-supporting members that are spaced apart from each other in said longitudinal direction and that are pivoted to said left and right seat rods of said base frame so as to be rotatable relative to said base frame about an axis, each of said front and rear armrest-supporting members including left and right poles that sandwich said left and right seat rods of said base frame therebetween, and a stopper, each of said left and right poles being pivoted to a respective one of said left and right seat rods and a respective one of said left and right armrests, and having a lower end that is disposed below said base frame, said stopper being disposed below said base frame, extending laterally and transversely relative to said left and right seat rods of said base frame, and interconnecting said lower ends of said left and right poles, each of said front and rear armrest-supporting members being rotatable relative to said base frame about said axis between an extended position, in which each of said left and right poles extends downwardly and frontwardly from the respective one of said left and right armrests to said stopper, in which said stopper is disposed frontwardly of said axis, and in which said stopper abuts against said bottom ends of said left and right seat rods, and a folded position, in which each of said left and right poles extends downwardly and rearwardly from the respective one of said left and right armrests to said stopper, in which said stopper is disposed rearwardly of said axis, and in which said stopper abuts against said bottom ends of said left and right seat rods.

2. The foldable chair of claim 1, wherein each of said left and right armrests has a bottom end that is formed with a pair of brackets, each of which has a bight portion and two opposite arm portions extending from two opposite ends of said bight portion in said longitudinal direction and cooperatively defining a receiving space therebetween, each of said left and right poles further having an upper end that is opposite to said lower end, that is received in said receiving space in the respective one of said brackets, and that is pivoted to said arm portions of the respective one of said brackets, each of said left and right poles abutting against said bight portion of the respective one of said brackets when said left and right armrest-supporting members are disposed at said extended position.

3. The foldable chair of claim 2, wherein said base frame further includes a rear seat rod that extends in a transverse direction relative to said longitudinal direction and that interconnects said left and right seat rods, said foldable chair further comprising a position-adjusting member that extends rearwardly and downwardly from said backrest frame toward said rear seat rod, and that is formed with a series of engaging grooves which open downwardly, said rear seat rod releasably engaging a selected one of said engaging grooves so as to position said backrest frame at a desired inclination relative to said base frame.

4. A foldable chair comprising:

a seat unit having a base frame which includes left and right seat rods that extend in a longitudinal direction and that have bottom ends, respectively;

a backrest frame pivoted to said seat unit;

left and right armrests respectively disposed above and aligned with said left and right seat rods of said base frame; and front and rear armrest-supporting members that are spaced apart from each other in said longitudinal direction and that are pivoted to said left and right seat rods of said base frame so as to be rotatable relative to said base frame about an axis, each of said front and rear armrest-supporting members including left and right poles that sandwich said left and right seat rods of said base frame therebetween, and a stopper, each of said left and right poles being pivoted to a respective one of said left and right seat rods and a respective one of said left and right armrests, and having a lower end that is disposed below said base frame, said stopper being disposed below said base frame, extending laterally and transversely relative to said left and right seat rods of said base frame, and interconnecting said lower ends of said left and right poles, each of said front and rear armrest-supporting members being rotatable relative to said base frame about said axis between an extended position, in which said stopper is disposed frontwardly of said axis and abuts against said bottom ends of said left and right seat rods, and a folded position, in which said stopper is disposed rearwardly of said axis and abuts against said bottom ends of said left and right seat rods.

* * * * *